US005323932A

United States Patent [19]

Bauman

[11] Patent Number: 5,323,932

[45] Date of Patent: Jun. 28, 1994

[54] PASTE DISPENSER

[76] Inventor: Michael G. Bauman, 837 N. Sumner Ave., Scranton, Pa. 18504

[21] Appl. No.: 17,866

[22] Filed: Feb. 16, 1993

[51] Int. Cl.[5] ..... B65D 35/54

[52] U.S. Cl. ..... 222/96; 222/105

[58] Field of Search ..... 222/96, 103, 105, 336

[56] References Cited

U.S. PATENT DOCUMENTS

| | | | |
|---|---|---|---|
| 2,379,475 | 7/1945 | Campfens et al. | 222/103 X |
| 2,537,008 | 1/1951 | Abbott | 222/96 |
| 2,589,058 | 3/1952 | Corson et al. | 222/103 X |
| 2,674,392 | 4/1954 | Kunz | 222/96 X |
| 4,548,337 | 10/1985 | Morris | 222/96 |

*Primary Examiner*—Gregory L. Huson

[57] ABSTRACT

A dispenser for dispensing on demand a predetermined amount of a past like material from a compressible tube like container. The dispenser is characterized in that it supports the tube for access by a user, the dispenser having a movable cover normally closing the aperture, the dispenser exerting force on the tube to cause controlled dispensing of paste when the aperture is uncovering until a substantial portion of the tube is emptied, the housing means to use external force to dispense the balance of the paste in a controlled manner.

8 Claims, 2 Drawing Sheets

FIG. 4
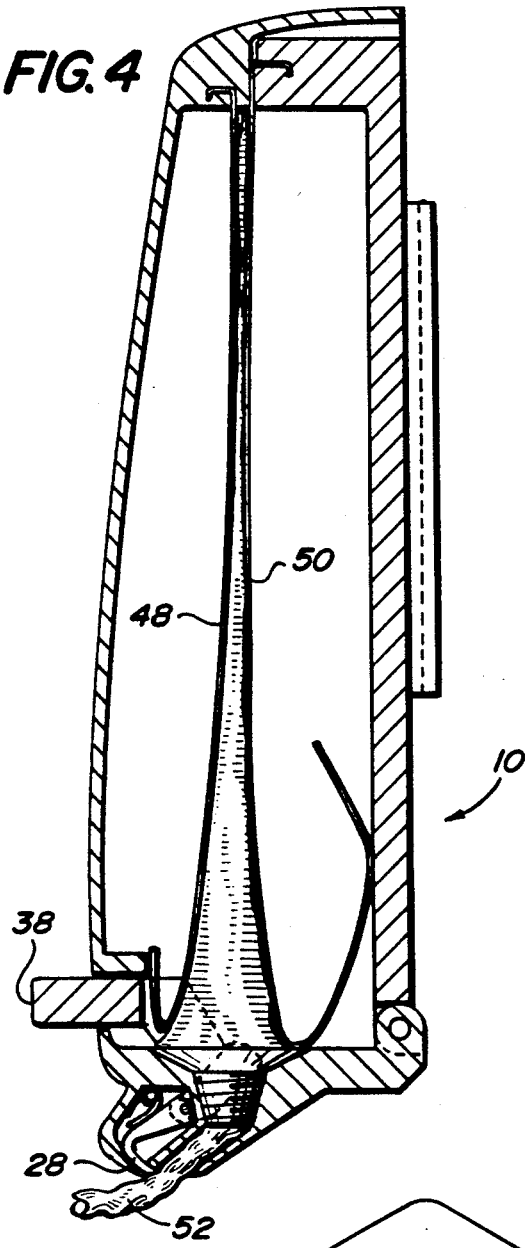
FIG. 5
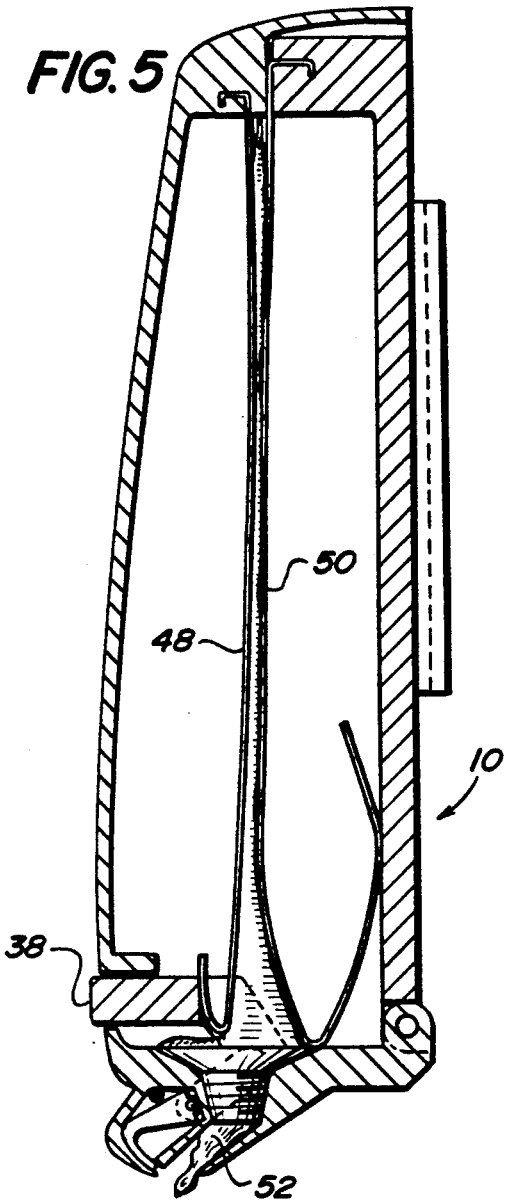
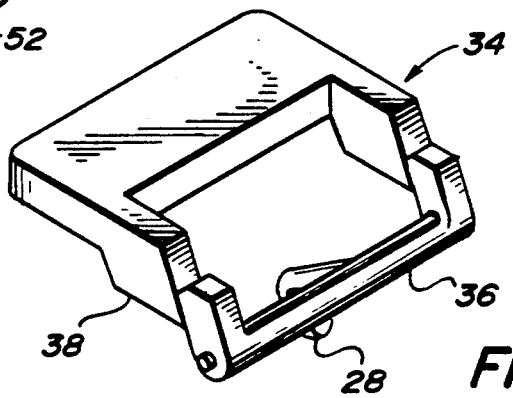
FIG. 3

PASTE DISPENSER

FIELD OF THE INVENTION

The present invention pertains to dispensers used to dispense paste, e.g. toothpaste from a compressible tube like container, e.g. toothpaste tube.

BACKGROUND OF THE INVENTION

There has been a long felt need for a simple and effective devise to be used to dispense paste from a tube in a controlled manner. For example, it is believed a toothpaste dispenser that can be readily mounted on the wall would encourage children and adults to better dental hygiene.

Over the years there have been numerous attempts to design a simple and effective paste dispenser. One of the more reasonable designs is that shown in U.S. Pat. No. 2,537,008. The problem with the device of the patent is that it requires numerous parts and a great deal of mechanical effort to dispense paste from the tube. Furthermore, the mechanism that permits access to the paste is that which exerts force on the tubular paste container thus permitting excess paste to be dispensed especially by young children.

SUMMARY OF THE INVENTION

The present invention is a paste dispenser that employs a housing that normally exerts pressure on a tube of paste contained in the housing so that when the dispensing aperture of the tube is uncovered by a cover contained on the housing paste is automatically dispensed from the tube. Dispensing of the paste takes place without excess pressure exerted on the tube so that there is less likelihood that the tube can be evacuated or a large quantity of paste dispensed the first time the dispenser is used. The dispenser is so constructed and arranged to permit a majority of the paste to be extracted by merrily uncovering the dispensing aperture of the tube. However, in order to completely evacuate the tube after the majority of the paste has been dispensed, the housing portions must be urged toward one and other each time the dispensing aperture is uncovered to force complete dispensing of the paste from the tube.

BRIEF DESCRIPTION OF THE DRAWING

FIG. 3 is an isometric view of an actuating mechanism for the closure of the present invention.

FIG. 4 is a plan view in section showing the device of FIG. 1 in a first stage of use.

FIG. 5 is a view similar to FIG. 1 showing the device in a second stage of use.

DETAILED DESCRIPTION OF THE INVENTION

Figures 1, 2:
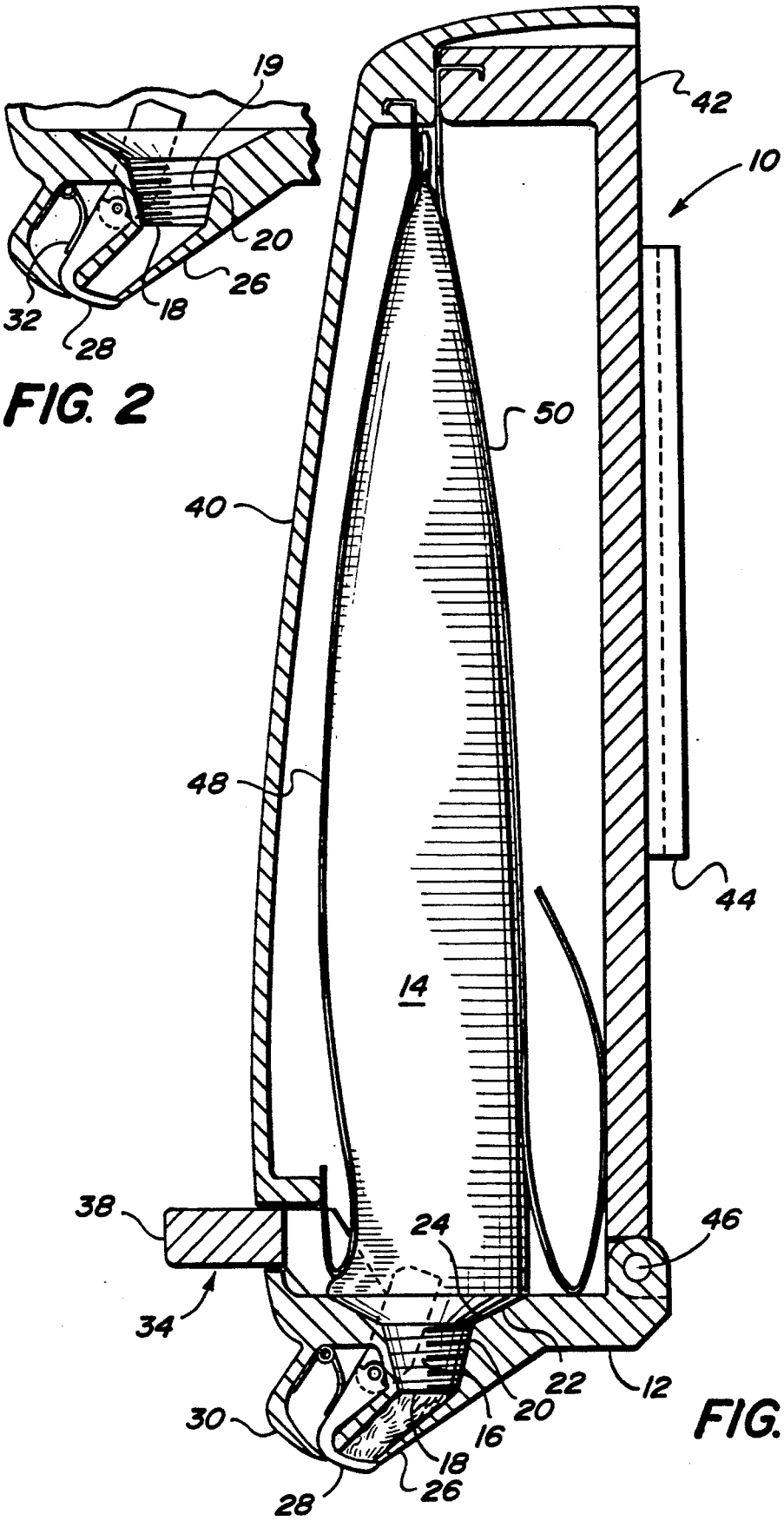
FIG. 1 is a plan view partially in section of a dispenser according to the present invention.
FIG. 2 is a fragmentary view showing the closure mechanism for the present invention.

The present invention pertains to dispensing paste like material from a collapsible or flexible walled tube such as commonly used for the storage of toothpaste.

As shown in FIG. 1 a dispenser shown generally as 10 includes a first means or base like portion 12 which is adapted to support a tube 14 of paste like material. The tube 14 has a neck portion 16 terminating in a dispensing aperture 18. Neck portion section 16 normally contains threads so that the aperture 18 in tube 14 can be closed by a cap (not shown). Base 12 includes complimentary universal threads in an aperture 20 that will receive a tube 14 and position it so that access can be obtained to the paste like material as it exits the aperture 18 of tube 14. Base 12 can include a complimentary concave portion 22 adapted to support the shoulder portion 24 of the conventional toothpaste tube 14. In developing the invention aperture 20 in base 12 was fabricated with two sets of threads 19. Threads 19 were found to fit all popular paste containing tubes when the course thread was cut in the wider portion of aperture 20 and a fine thread in the lower or minor portion of aperture 20. Base 12 includes a dispensing spout or chute 26 which is closed by a closure 28. The closure can be disposed within an outer closure housing 30 as shown in FIG. 1.

Referring to FIG. 2 the closure 28 normally closes the chute 26. The closure 28 can be biased by means of a spring 32 so that it normally prevents dispensing of paste from the tube. As shown in FIG. 3 the closure 28 can be fabricated as part of single piece bar actuator assembly shown generally as 34. The bar assembly 34 includes a support bar 36 to which closure 28 is fixed, bar 36 being coupled to an actuator knob or button assembly 38. The actuator assembly 34 is disposed in a slot contained between the base 12 and first moveable housing 40 which is adapted to be movably and removable fixed to a second housing portion 42. Second housing portion 42 is adapted to receive a mounting bracket 44 so that the dispenser 10 can be conveniently mounted to a flat surface such as a wall. Base 12 can be pivotably mounted to housing portion 42 by means of a pin 46 so that the interior of the housing can be accessed for ease in cleaning. Housing section 40 supports a first flat spring 48 which when the housing is closed after the tube 14 is installed exerts a force against one flexible wall tube 14. Housing section 42 includes a second spring 50 complimentary in shape to the first spring 48 which is adapted for urging the spring 50 against an opposite side of the tube 14.

Springs 48, 50 are fabricated from flat spring steel such as an AIS 1070 flat rolled spring steel 0.025 inches thick which have been heat treated by quenching and tempering to a hardness of approximately Rockwell "C" 52.;

When the device or dispenser 10 is assembled with the tube in place and the covers 40, 42 are in their normal position juxtaposed to one and other there is sufficient pressure exerted on the tube 14 so that when the button 38 is urged to the right as shown in FIG. 4 the closure 28 is moved and paste is dispensed from the tube. Immediately upon release of the button closure 28 is urged into its first or closed position and flow of the paste stops. By constructing the device according to the present invention using the flat springs as shown and positioning the springs as shown there is not sufficient pressure on the tube so that as soon as the closure 28 is open all of the paste is immediately evacuated from the tube. Thus the invention has a two stage feature. First the springs are used to cause partial evacuation of the tube as shown in FIG. 4 by using the closure mechanism only to open the tube to dispensing of the paste shown as 52 in FIG. 4. With the device of the present of invention at a time after a substantial portion of the paste has been dispensed the springs have reached their full effective use in dispensing the paste. Thereafter, as shown in FIG. 5 in order to complete dispensing of the paste 52 the button 38 as it is urged to the right forces spring 48 to be urged toward spring 50 thus physically squeezing the remaining paste from the tube. When the phrase "remaining paste" is used it is not taken to mean that 100% of the paste is removed. This could happen but is highly unlikely there being no residual paste in the tube.

While the invention has been shown and described with a pair of flat springs 48, 50 as the operative mechanism to force paste from the tube it is entirely possible to design the housing with molded in shapes and at least one auxiliary spring that would pull the housing halves together to achieve the same effect, of course, the spring would have to be chosen to have the two stage effect that the device shown and described in the drawing has.

Having thus described what is believed to be the best embodiment of the present invention what is desired to be secured by letters patent of the United States is set forth in the appended claims.

I claim:

1. A paste dispenser comprising in combination;

first means to removably support a flexible walled tube containing an aperture through which said paste is normally dispensed, said first means adapted for positioning said aperture at a convenient location for a user of said paste and said first means including moveable closure means to permit or interrupt flow of paste through said aperture;

second means to apply force to said flexible walls of said tube to normally urge said walls toward one another and move paste through said aperture when said moveable closure means uncovers all or a portion of said aperture, said second means adapted by itself to cause only a portion of the total quantity of said paste originally contained in said tube to be dispensed from said tube when said moveable closure means permits uninterrupted flow of paste through said aperture; and third means cooperating with said second means to cause almost complete dispensing of said paste after said second means has acted to its full extent.

2. A paste dispenser according to claim 1 wherein said first means includes a base having a threaded aperture with a first or wide portion containing coarse threads and a second or minor portion containing fine threads to secure conventional paste tubes by means of its threaded dispensing aperture.

3. A paste dispenser according to claim 1 wherein said first means is a base plate, a bracket hingeably connected to said base plate and a removable cover, said removable cover adapted to be removably fixed to said bracket for movement toward and away from said bracket and said bracket fixed to said base plate at a generally right angle thereto.

4. A paste dispenser according to claim 3 wherein a pair of elongated flat springs are fixed to said bracket plate and said cover respectively, said springs facing each other and adapted to bear against opposite sides of said flexible walled tube.

5. A paste dispenser according to claim 4 wherein said springs are formed in an arcuate shape, the radius of the arc being perpendicular to the longitudinal axis of said springs.

6. A paste dispenser according to claim 1 wherein said movable closure means comprises a generally flat closure normally secured to said first means, said closure actuated by said third means, said third means adapted to move said moveable closure only until said second means no longer causes paste to be dispensed when said moveable closure is removed from said aperture and thereafter to cooperate with said second means to force paste from said tube when said moveable closure is removed from said aperture.

7. A paste dispenser according to claim 6 including biassing means to cause said closure to cover said aperture when paste is not being dispensed.

8. A paste dispenser according to claim 1 wherein said second means includes a pair of generally flat springs formed into an actuate shape, one of said springs is fixed to said first means by means of a bracket fixed to said first means, said springs adapted to contact opposite sides of said flexible walled tube said springs adapted to in combination with said first means support said tube for dispensing of said paste, said springs normally biased toward one another.

* * * * *